United States Patent [19]

Motoyama

[11] 4,060,234

[45] Nov. 29, 1977

[54] CARTRIDGE TRAY FOR USE IN A COPYING MACHINE

[75] Inventor: Masamitsu Motoyama, Tokyo, Japan

[73] Assignee: Rank Xerox Ltd., London, England

[21] Appl. No.: 709,032

[22] Filed: July 27, 1976

[30] Foreign Application Priority Data

Aug. 27, 1975 Japan ..... 50-117006[U]

[51] Int. Cl.[2] ..... B65H 3/56

[52] U.S. Cl. ..... 271/164; 271/169

[58] Field of Search ..... 271/162, 164, 167, 169–171

[56] References Cited

U.S. PATENT DOCUMENTS

| | | | |
|---|---|---|---|
| 2,226,003 | 12/1940 | Levenhagen | 271/169 |
| 2,260,045 | 10/1941 | Morrison et al. | 271/169 X |
| 2,266,068 | 12/1941 | Peterson et al. | 271/169 |
| 2,775,451 | 12/1956 | Styles | 271/169 |
| 2,857,159 | 10/1958 | Keil | 271/169 |
| 2,961,947 | 11/1960 | Springer | 271/169 X |
| 3,672,665 | 6/1972 | Schnall et al. | 271/164 |

OTHER PUBLICATIONS

Jennings; Self-Adjusting Right Hand Paper Guide, IBM Technical Disclosure Bulletin, vol. 15, No. 7, 12–1972, pp. 2166.

*Primary Examiner*—Robert W. Saifer

[57] ABSTRACT

A cartridge tray for use with a copying machine and having pressor pads adapted to be automatically reset to their operative or bias generating position upon positioning the tray in the copy machine.

2 Claims, 4 Drawing Figures

CARTRIDGE TRAY FOR USE IN A COPYING MACHINE

BACKGROUND OF THE INVENTION

The present invention relates to cartridge trays for positioning a stack of sheets of copy paper in a copying machine.

The conventional cartridge tray for receiving a stack of sheets of copy paper in a copying machine generally includes, as illustrated in FIG. 1, a pair of side pads b supported one at each side of the tray main body by means of leaf springs a. The sheets of copy paper received in the tray are abutted by these pads b at their opposite sides so as to prevent more than one sheet from being fed at one time by the application of a frictional force thereto. When the sheets are to be replenished, the lever C is swung in the direction of arrow A to retract the pads in the direction of arrow B, thereby providing a wider space inside the tray to facilitate replenishing. After replenishment, the lever C is swung in the opposite direction to again bring the pads into close contact with the sides of the stack of sheets. However, this latter operation if often overlooked in the conventional tray, thus leading to double-sheet feeding.

OBJECTS & SUMMARY OF THE INVENTION

The object of the present invention is, therefore, to overcome the above described disadvantage and to provide a novel cartridge tray for use with a copying machine having pressor pads which are adapted to be automatically returned to their operative position after completion of the process of setting the tray in the machine, thereby avoiding or rendering less likely the feeding of more than one sheet at a time.

The above object is accomplished by the provision of a cartridge tray for use in a copying machine comprising a tray main body consisting of a bottom plate and a pair of opposite side plates, a pair of leaf springs provided one at each side, a pair of side pads secured at the ends of the leaf springs for imparting a bias pressure to the sides of the sheets of copy paper. A pair of actuating members, each having a thick upper portion and a thin lower portion are mounted for free up-and-down movement between the side plates and the leaf spring, the actuating members being arranged such that when the thick portion is positioned between the side plates and the leaf spring, the lower end of the actuating member extends downwards beyond the bottom plate of the tray main body.

BRIEF DESCRIPTION OF THE DRAWINGS

Other objects and advantages of the present invention will become apparent upon reading the following detailed description and upon reference to the drawings, in which.

DETAILED DESCRIPTION OF THE INVENTION

Figure 1:
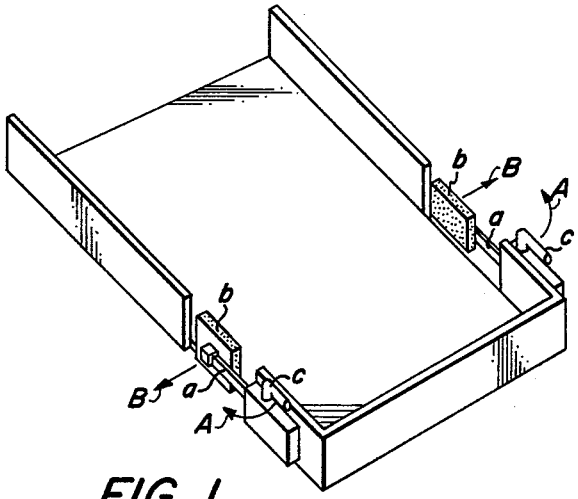
FIG. 1 PRIOR ART
FIG. 1 is a perspective view of a conventional cartridge tray.
Figure 2:
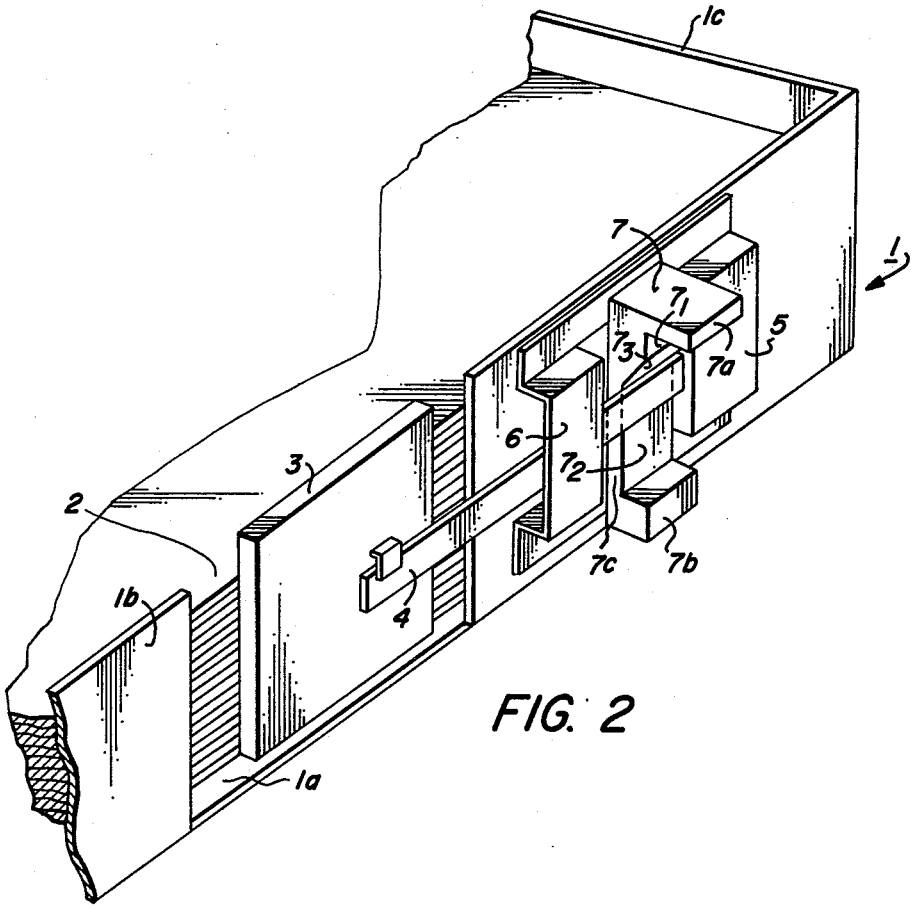
FIG. 2 is a perspective view of the essential parts of the cartridge tray according to the present invention.
Figure 3:
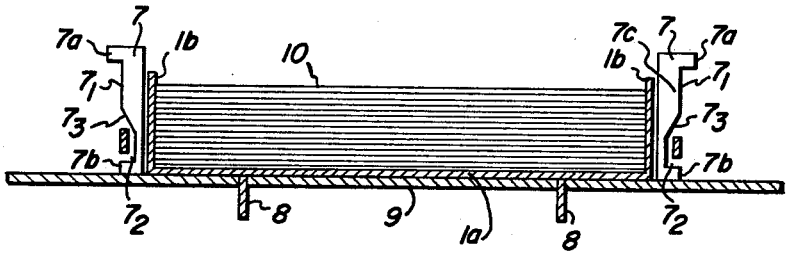
FIGS. 3 and 4 are sectional views of the tray illustrating the mode of operation of the actuating member.
Figure 4:
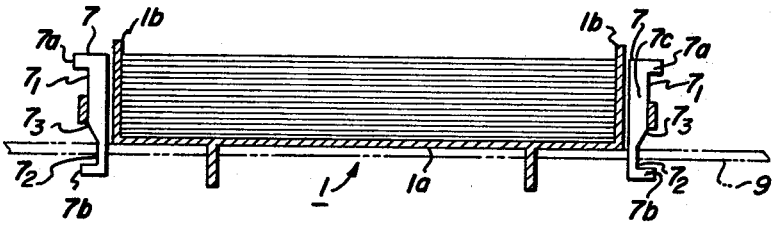

The present invention will now be described in detail with reference to an embodiment shown in the attached drawings, in which FIG. 2 is a perspective view of the essential parts of the cartridge tray according to the invention, and FIGS. 3 and 4 are sectional views of the tray illustrating the function and mode of operation of the actuating member. In the drawings, there is shown a tray main body 1 consisting of a bottom plate 1*a*, a pair of side plates 1*b* provided at opposite ends of the bottom plate, and another side plate 1*c*. A recess 2 is provided in each of the side plates 1*b*. A pressor pad or friction pad 3 is mounted in the recess 2. The pad 3 is secured to an end of a leaf spring 4, the opposite end of the spring 4 being rigidly mounted to the exterior face of the side plate 1*b* by means of a suitable fastening means 5. A guide member 6 having a substantially C-shaped section is mounted to the side plates 1*b* at the middle of the leaf spring 4 so as to limit the swinging movement of the spring 4. Between the guide member 6 and the fastening means 5 there is provided an actuating member 7. The actuating member 7 has a substantially C-formed section and is formed with upper and lower free ends 7*a* and 7*b*, and an intermediate portion 7*c* connecting the ends. The intermediate portion 7*c* comprises a thin walled portion $7_2$ and a thick walled tapered portion $7_1$, these portions having formed therebetween a tapered or inclined surface $7_3$. The actuating member 7 is interposed between the side plate 1*b* and the leaf spring 4. At the bottom of the bottom plate 1*a* there are provided projections 8 extending downwardly therefrom for positioning the cartridge tray upon a tray receiving plate 9 in registration therewith.

When the tray 1 is set in the copying machine to rest upon the tray receiving plate 9, as shown in FIG. 3, the lower end of the actuating member 7 will bear against the upper surface of the plate 9 to lift the actuating member 7 so that the thin portion $7_2$ of the actuating member 7 is faced with and is distant from the leaf spring 4. As a result, the spring 4 exerts its force upon the pad 3 whereby the lateral sides of the stack of sheets 10 in the tray are gripped and pressed inwardly by the friction pad 3 thereby preventing more than a sheet from being fed at one time. When a new stack of sheets is to be replenished in the tray after the original sheets have been depleted, the operator first removes the tray 1 from the machine and then presses down the actuating member 7 as shown in FIG. 4. At the actuating member is lowered, the tapered portion $7_3$ is slid between the side wall and the spring 4, forcing the spring outwardly until it comes to rest against the thick walled land or portion $7_1$. The pad 3 attached to the spring 4 is thus forced to swing outwardly to retract from its operating position in biased contact with the stack of sheets. Thus, a new sheet of copy paper will be readily set in the tray. After replenishment, the operator resets the cartridge tray 1 to rest upon the tray receiving plate 9 whereby the lower end of the actuating member 7 is caused to be lifted upwards by the upper surface of the tray receiving plate 9 so that the leaf spring 4 is disengaged from the land or thick portion $7_1$ of the actuating member 7 and is brought again into abutment with the thin portion $7_2$. Consequently, the spring 4 returns to its operating position, as shown in FIG. 3, thereby exerting a force on the pad 3 which, in turn, presses and grips the side of the stack of sheets.

As described hereinabove, the cartridge tray according to the present invention has a provision for automatically returning the pressor pads, having been released at the time of replenishment, to their operating position upon resetting of the tray on the machine. Therefore, the risk of double sheet feeding due to the operator overlooking the resetting of cartridge tray pressor pads is avoided. Since the aforementioned provision merely includes additional actuating members of simple construction, the device according to the invention may be realized readily and at a low cost.

While the present invention has been described in connection with a preferred embodiment thereof, it will be understood that it is not intended to limit the invention to that embodiment. On the contrary, it is intended to cover all alternatives, modifications and equivalents as defined by the appended claims.

What is claimed is:

1. A paper tray positionable in abuting relationship with a surface of a copier machine for holding a stack of paper comprising a movable guide, spring means for continously biasing said guide toward said stack to a first position in abutment with said stack, and actuator means adapted for manual movement to a first position for moving said guide against said bias and away from said stack to a second position, said actuator means movable to a second position by abutment with said surface upon insertion of said tray into said machine for permitting said actuator means to return to said first position, said surface being located in a horizontal plane and said actuator being movable vertically between said first and second positions, said second position being vertically above said first position.

2. The combination recited in Claim 1 wherein said guide comprises a vertically oriented wall segment, said spring means comprises an elongated leaf spring oriented in a horizontal plane and pivoted adjacent its end remote from said guide, said actuator means comprising a cam bearing against said leaf spring intermediate said guide and said pivot.

* * * * *